US007661158B2

(12) United States Patent
Daeseleire

(10) Patent No.: US 7,661,158 B2
(45) Date of Patent: Feb. 16, 2010

(54) FOLDING COT

(75) Inventor: Bruno Jozef Ivo Frans Maria Ghisleen Daeseleire, Brasschaat (BE)

(73) Assignee: MYKKO, naamloze vennootshap, Schoten (BE)

( * ) Notice: Subject to any disclaimer, the term of this patent is extended or adjusted under 35 U.S.C. 154(b) by 210 days.

(21) Appl. No.: 11/330,251

(22) Filed: Jan. 12, 2006

(65) Prior Publication Data

US 2006/0150323 A1 Jul. 13, 2006

(30) Foreign Application Priority Data

Jan. 12, 2005 (BE) ..... 2005/0018

(51) Int. Cl.

| | |
|---|---|
| ***A47D 9/00*** | (2006.01) |
| *A47D 7/00* | (2006.01) |
| *A47D 13/06* | (2006.01) |
| *B68G 5/00* | (2006.01) |
| *A47C 16/00* | (2006.01) |
| *B60N 2/00* | (2006.01) |
| *B60N 2/02* | (2006.01) |
| *B60N 2/48* | (2006.01) |

(52) U.S. Cl. ..... 5/102; 5/93.1; 5/93.2; 5/655; 297/354.13; 297/373

(58) Field of Classification Search ..... 5/99.1, 5/93.1, 98.2, 655, 94, 93.2, 102; 297/17, 297/183.5, 354.13, 373

See application file for complete search history.

(56) References Cited

U.S. PATENT DOCUMENTS

| | | | | |
|---|---|---|---|---|
| 3,054,637 | A * | 9/1962 | Pambello | 297/4 |
| 3,361,473 | A * | 1/1968 | Dudouyt | 297/373 |
| 3,999,490 | A | 12/1976 | Rocker et al. | |
| 5,092,004 | A | 3/1992 | Cone et al. | |
| 5,551,109 | A * | 9/1996 | Tingley et al. | 5/655 |
| 6,026,525 | A | 2/2000 | Davis | |
| 2004/0177446 | A1 | 9/2004 | Robb et al. | |
| 2004/0250351 | A1 | 12/2004 | Brewin et al. | |

FOREIGN PATENT DOCUMENTS

| | | | |
|---|---|---|---|
| DE | 39 08 508 | A1 | 9/1990 |
| DE | 195 30 717 | A1 | 2/1997 |
| EP | 1 000 571 | A1 | 5/2000 |
| GB | 2 283 670 | | 5/1995 |
| WO | WO 2004/024492 | A1 | 3/2004 |

OTHER PUBLICATIONS

Search Report of European Patent Office relating to EP 05 07 8053 5, Jun. 2, 2006, with examination report (5 pgs ).

* cited by examiner

*Primary Examiner*—Pete Cuomo
*Assistant Examiner*—Jonathan J Liu
(74) *Attorney, Agent, or Firm*—Bacon & Thomas Pllc.

(57) ABSTRACT

Cot, characterized in that it consists of two shell parts (2, 3) which are made of a hard material and which are hinge-mounted, whereby an upholstery (4) is provided around both shell parts (2, 3), and whereby both shell parts (2, 3) can mutually hinge between an open position, in which both shell parts (2, 3) are in line, and a closed position, in which both shell parts (2, 3) are folded together.

9 Claims, 7 Drawing Sheets

FOLDING COT

BACKGROUND OF THE INVENTION

1. Field of the Invention

The present invention concerns a cot, in particular a cot of the type which can be easily taken along and which is designed to be unfolded in an armchair or the like for a baby to sleep in.

2. Discussion of the Related Art

Such cots are already known which consist of an upholstery which can be folded double with two halves is against one another, whereby a hard core is provided in one of both halves in the shape of half a shell.

A disadvantage of such cots is that they cannot be moved while a baby is lying in it without disturbing the baby.

Indeed, when such a cot is lifted, the shell part which is made of a supple material needs to be supported, in order to prevent that the baby who is lying in the cot would fall out of it, whereby, while supporting the shell part, the baby is indirectly supported as well, which may disturb the baby in his sleep in many cases.

The present invention aims to remedy the above-mentioned and other disadvantages.

SUMMARY OF THE INVENTION

To this end, the invention concerns a cot which consists of two shell parts which are made of a hard material and which are hinge-mounted, whereby an upholstery is provided around both shell parts, and whereby both shell parts can mutually hinge between an open position, in which both shell parts are in line, and a closed position, in which both shell parts are folded together.

An advantage of the present invention is that the cot fully supports the baby who, consequently, can stay sleeping in the cot without any risk and without being disturbed while the cot is being moved.

The cot according to the invention preferably contains clamping means which make it possible to lock both shell parts in relation to each other.

Such a preferred embodiment is advantageous in that the cot can be easily lifted, when it is locked in an open position, without the risk of both shell parts spontaneously collapsing.

BRIEF DESCRIPTION OF THE DRAWINGS

In order to better explain the characteristics of the present invention, the following preferred embodiment of a cot according to the invention is given as an example only, without being limitative in any way, with reference to the accompanying drawings, in which.

DESCRIPTION OF THE PREFFERED EMBODIMENT

Figure 1:
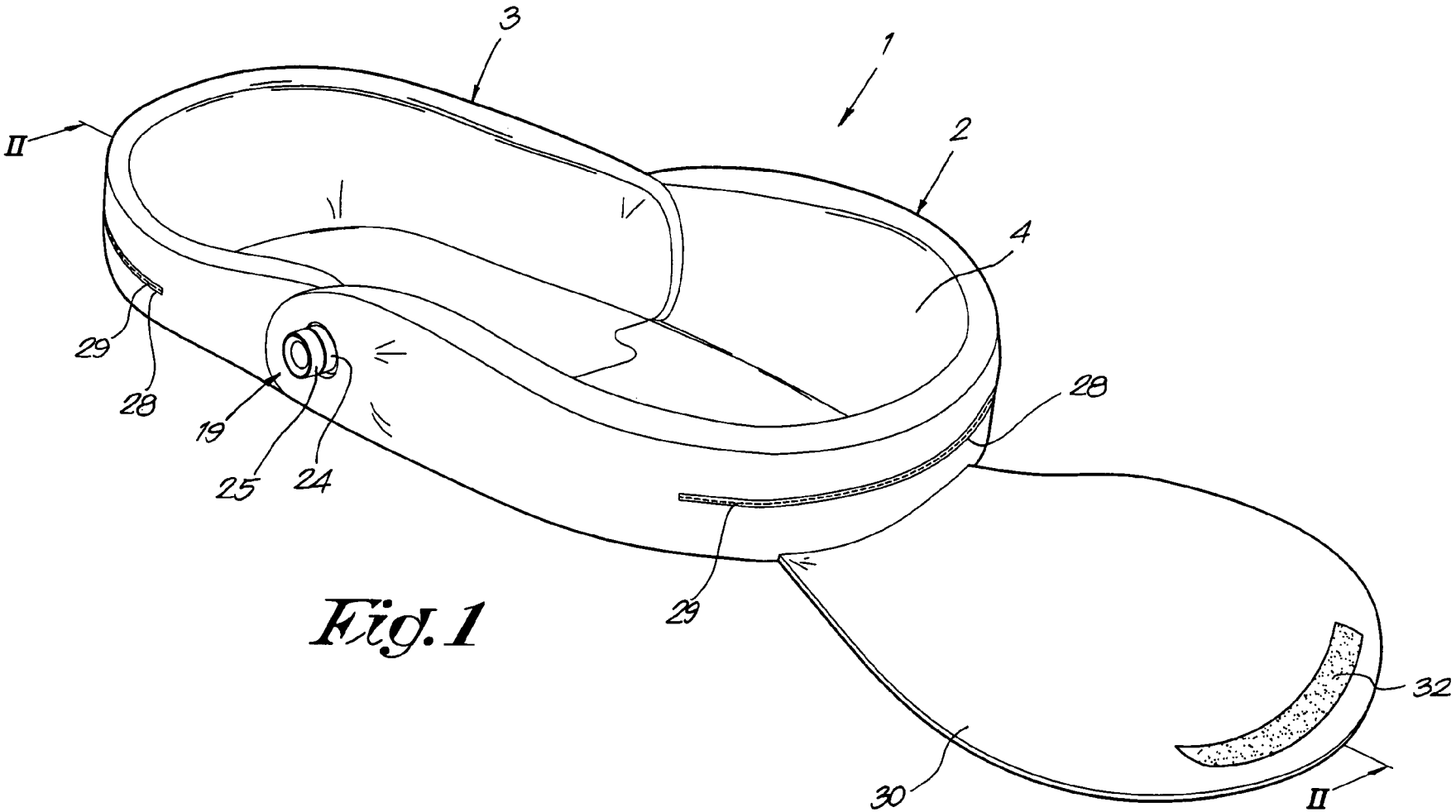
FIG. 1 shows a view in perspective of a cot according to the invention in an open position.
Figure 2:
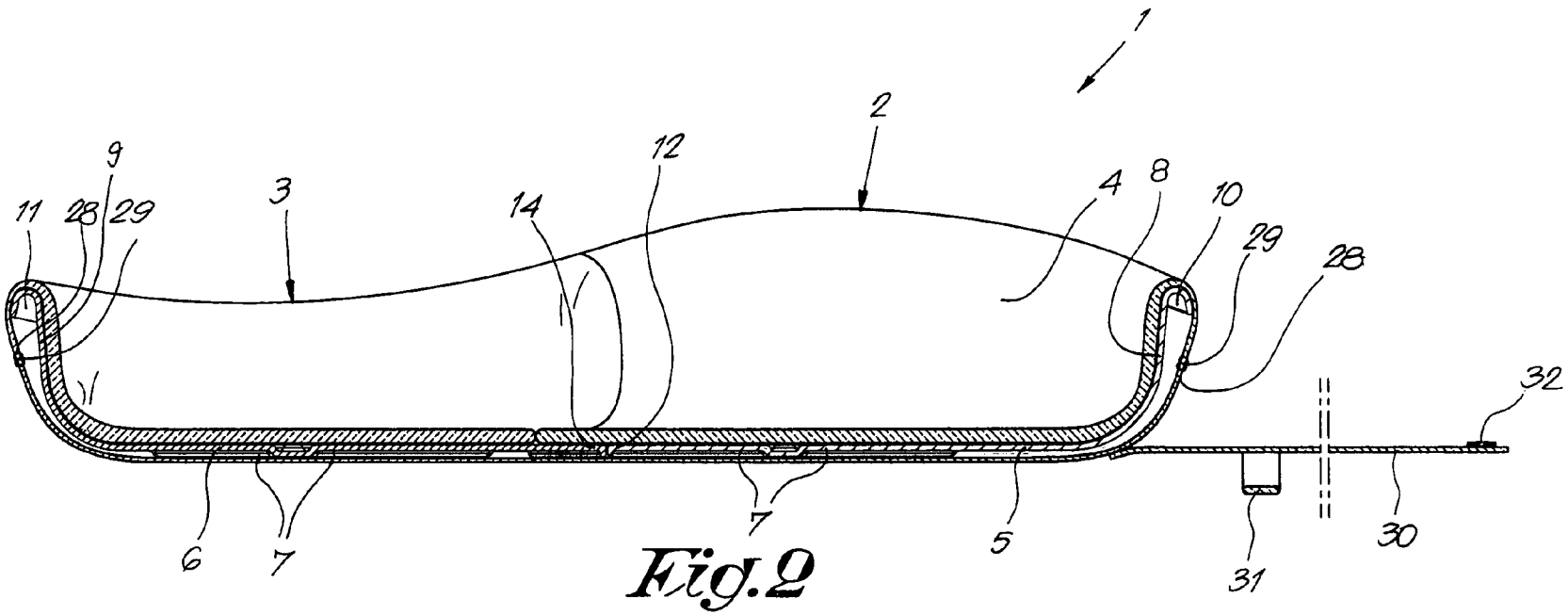
FIG. 2 is a section according to line II-II in FIG. 1 to a larger scale.
Figure 3:
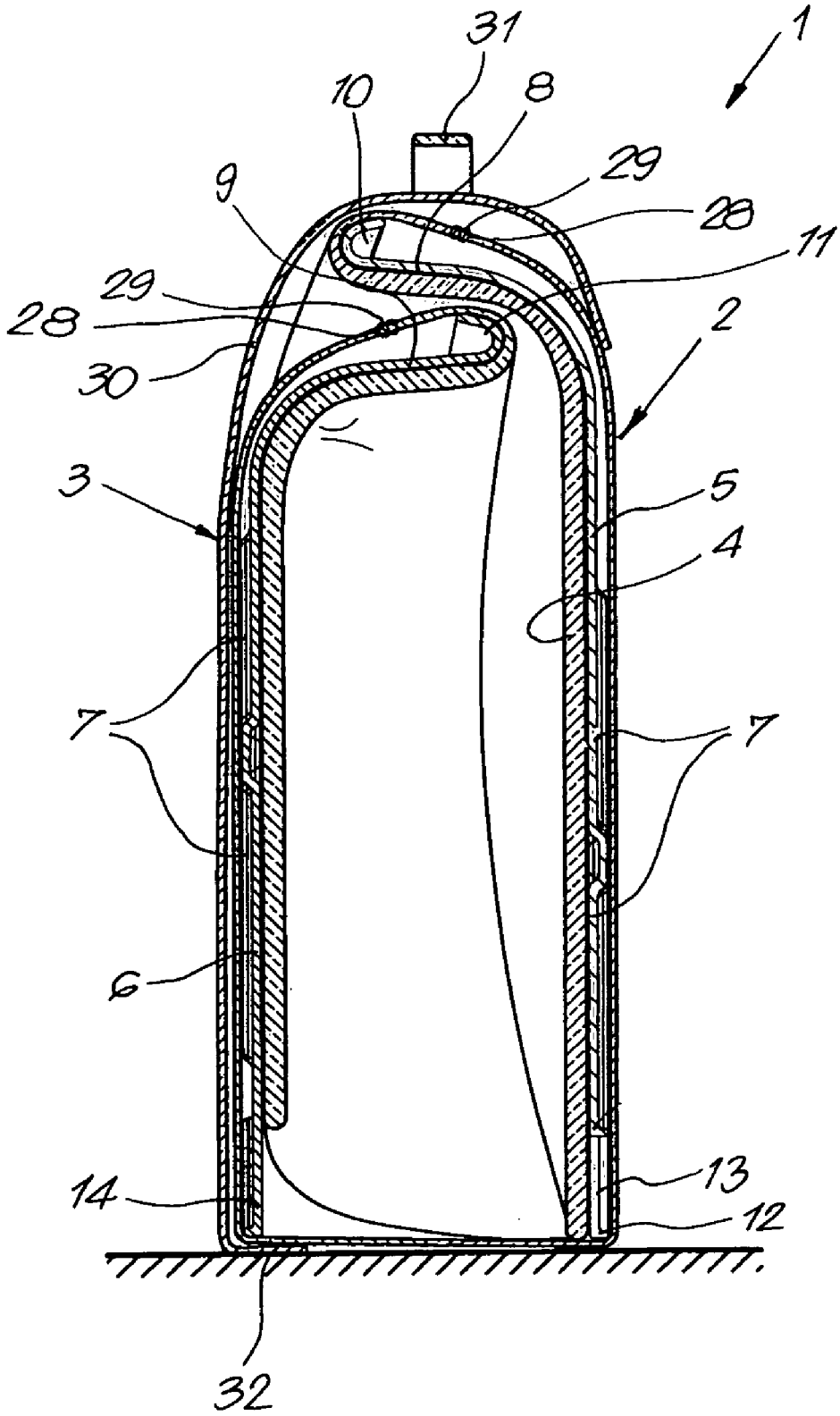
FIG. 3 represents the same section as in FIG. 2, but in a closed position of the cot.

FIGS. 1 to 3 represent a cot 1 according to the invention which mainly consists of two half shell parts 2 and 3 which are made of a rigid but more or less flexible plastic or the like around which is provided an upholstery 4.

Figure 4:
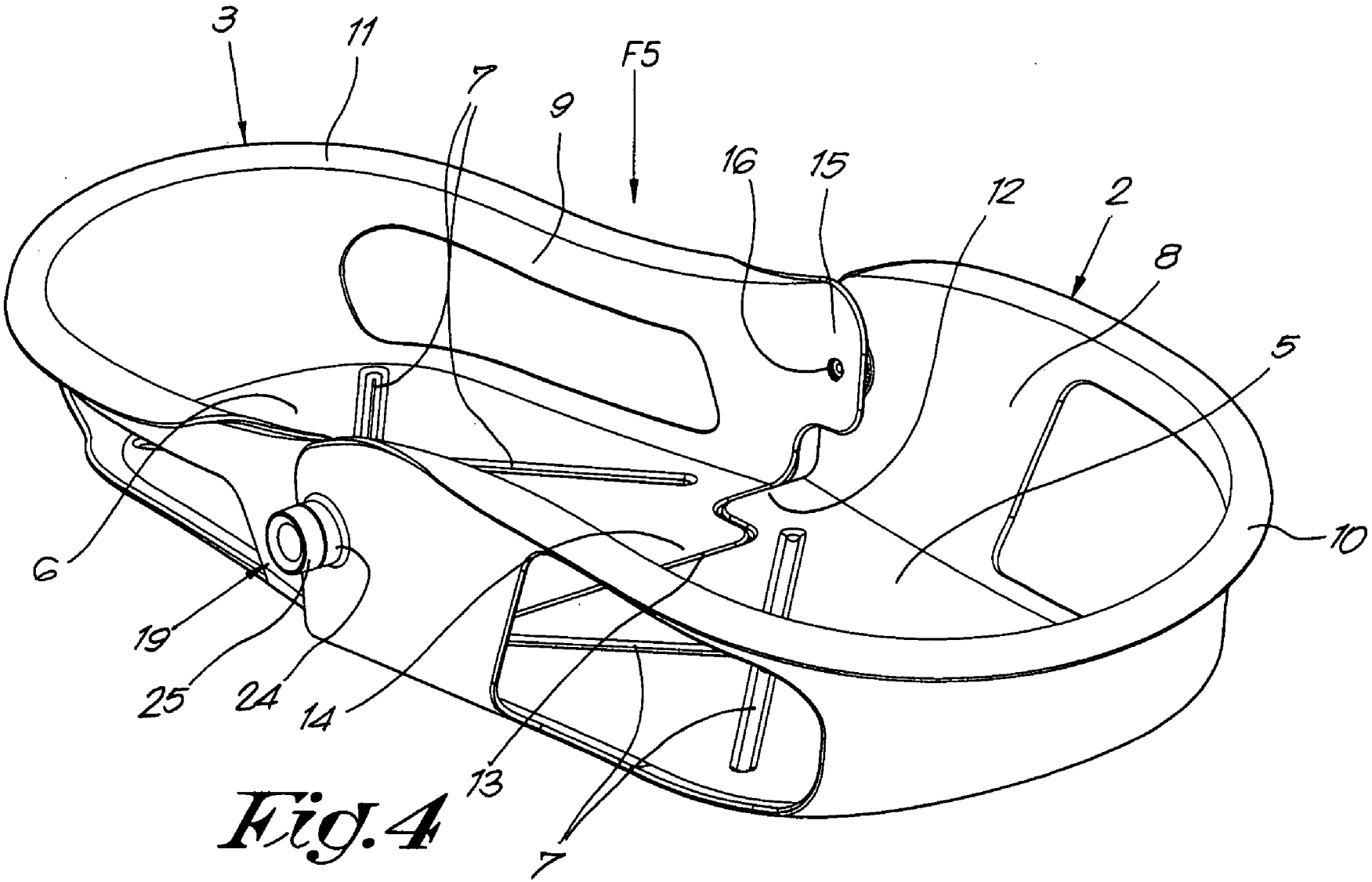
FIG. 4 represents the cot of FIG. 1, but without any upholstery.
Figure 5:
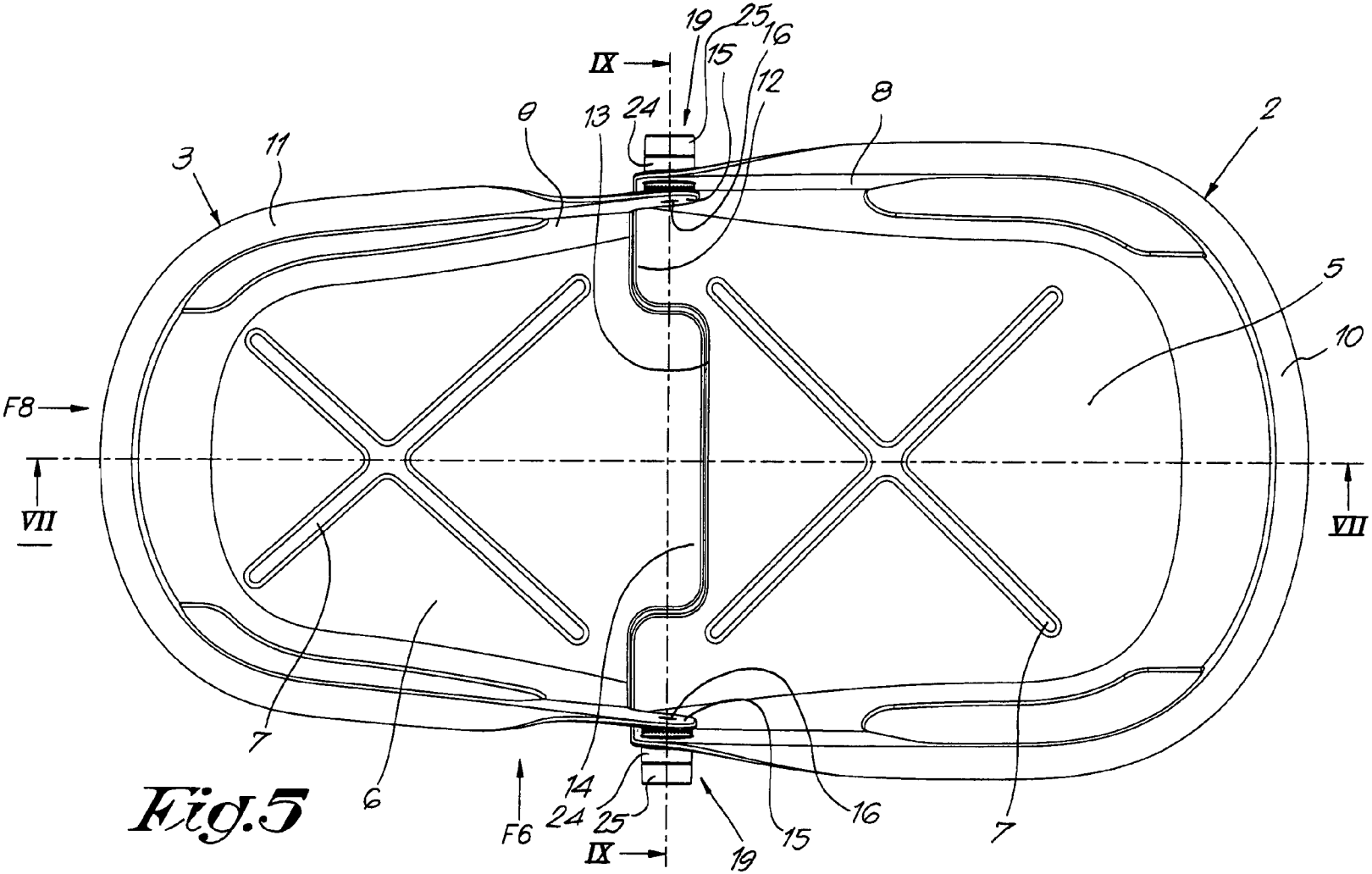
FIG. 5 represents a view according to arrow F5 in FIG. 4 to a larger scale.
Figure 6:
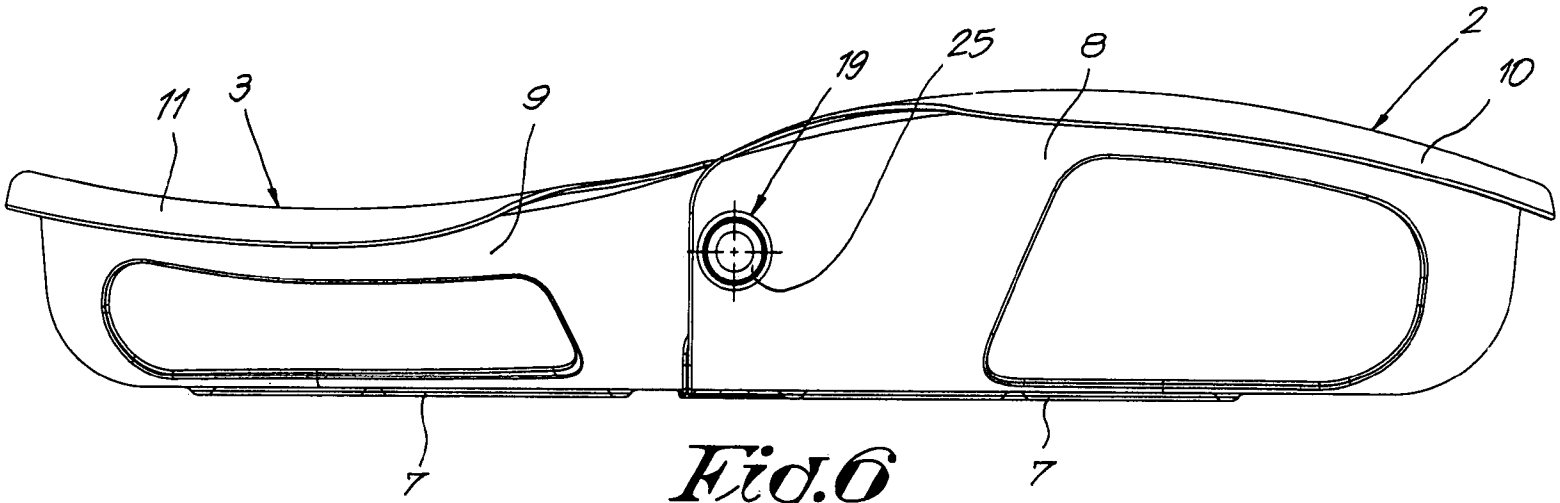
FIG. 6 represents a view according to arrow F6 in FIG. 5.
Figure 7:
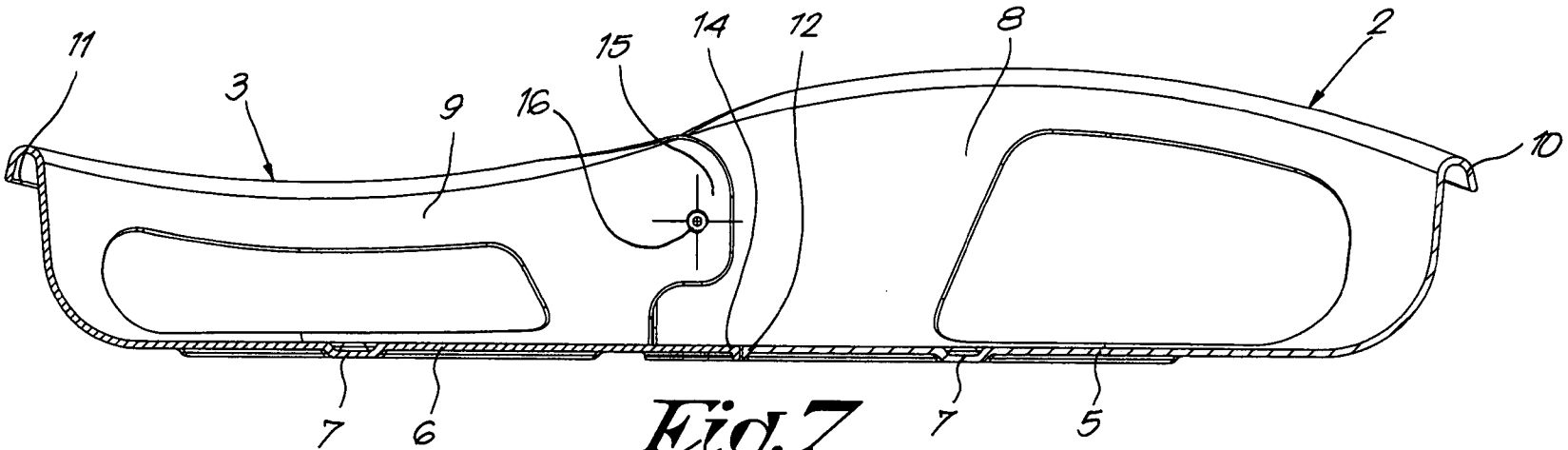
FIG. 7 represents a section according to line VII-VII in FIG. 5.
Figure 8:
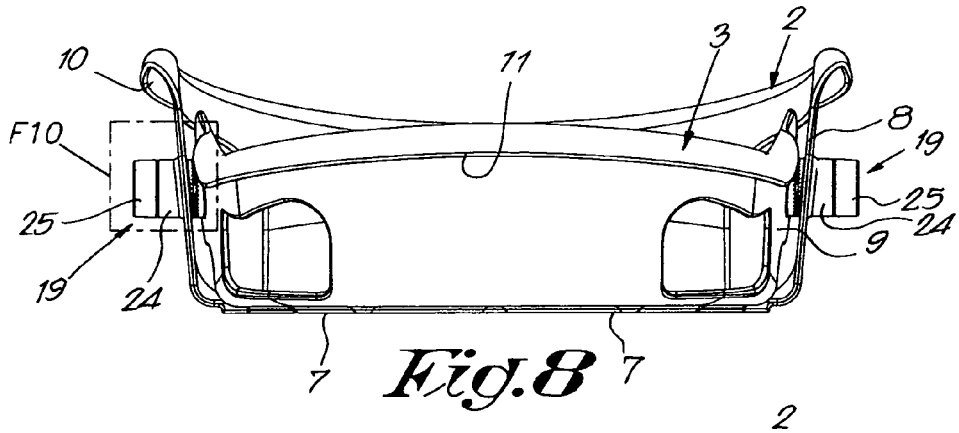
FIG. 8 represents a view according to arrow F8 in FIG. 5.
Figure 9:
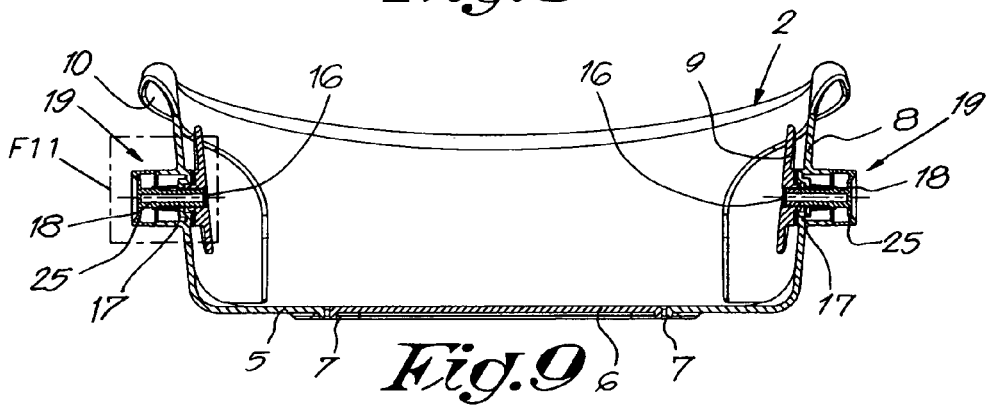
FIG. 9 represents a section according to line IX-IX in FIG. 5.
Figure 10:
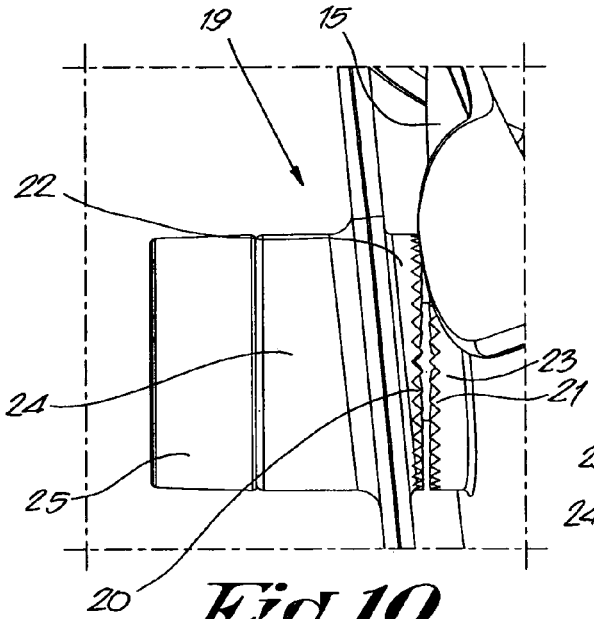
FIGS. 10 and 11 represent the parts F10 and F11 in FIG. 8, FIG. 9 respectively.
Figure 11:
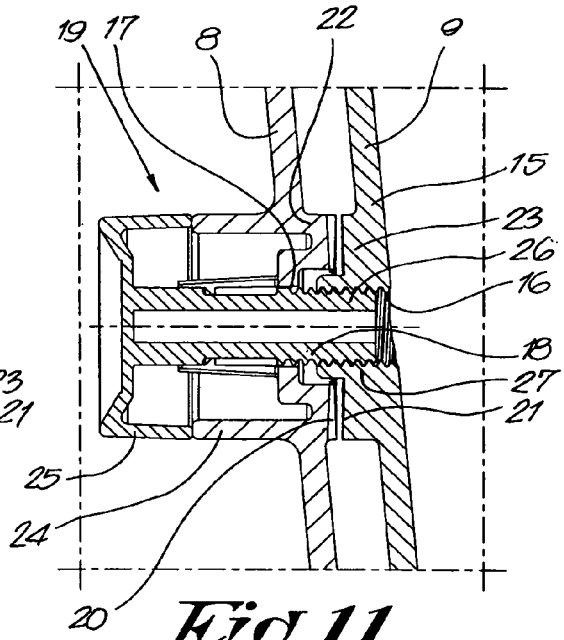

As is represented in FIG. 4, both shell parts 2 and 3 consist of a bottom plate 5, 6 which is preferably provided with reinforcement ribs 7 and which is provided on three sides, along its perimeter, with a standing wall 8, 9 die which has an outward bent collar 10, 11 on its top side. The standing side walls 8, 9 terminate at free far ends 15, 16 of the bottom plates 5, 6.

The edge 12 on the open side of the bottom plate 5 of the first shell part 2 is provided with a recess 13 which extends over practically the entire central length of this edge 12, whereas the opposite edge 14 of the bottom plate 6, on the open side of the second shell part 3, includes a protrusion that is complementary to the above-mentioned recess in the edge 12, but has a length which is at least somewhat shorter than the length of this edge 12 of the first shell part 2.

The standing wall 9 of the second shell part 3 has been extended somewhat on its free far ends 15 in relation to the adjacement portion of the free edge 14 of the bottom plate of this shell part 3, whereby these extended far ends 15 and the far ends of the standing wall 8 of the first shell part 2 overlap.

In the overlapping far ends of both shell parts is each time provided a hole 16, 17 through which is each time provided a hinge pin 18.

Both coaxial hinge pins 18, one on each overlapping far end of the standing walls 8 and 9, hereby form a hinge between both shell parts 2 and 3.

As is represented in FIGS. 1 and 8 to 11, at one or both coaxial hinge joints, between both shell parts 2, 3, are provided clamping means 19 which make it possible to lock both shell parts 2, 3 in relation to each other. The clamping means 19 extend outwardly through apertures in the upholstery as shown in FIG. 1.

These clamping means 19 in this case consist of two ring-shaped gearings 20, 21 with radially directed teeth provided opposite each other on the sides of the overlapping far ends of the standing walls 8, 9 of both shell parts 2, 3, which sides are directed towards each other.

In this case, the gearings 20, 21 are provided on ring-shaped thickenings, 22 and 23 respectively, around the holes 16 and 17, whereby both gearings 20 and 21 can work in conjunction so as to lock the hinge joint between both shell parts 2 and 3.

Also in this embodiment of the clamping means 19 is provided on the outside of the standing wall 8 of the first shell part 2, around each of the holes 17, a ring-shaped protrusion 24, and the above-mentioned hinge pins 18 are provided with a turning knob 25 on one far end whose circumferential edge is at least as large as the diameter of the ring-shaped protrusions 24, whereas the hinge pins 18 are provided with screw thread 26 on their other far ends, and the holes 17 are made as threaded holes 27.

The above-mentioned upholstery 4 of the cot 1 in this case consists of a cloth which is made such that it assumes the shape of the plastic shell parts, whereby the part of the cloth which covers the inside of the cot is preferably made somewhat thicker or is provided with an additional, deformable layer which serves as a mattress for a baby.

In the upholstery 4 is preferably provided an opening 28, on one or both far ends of the cot 1, through which the shell parts 2 and 3 can be removed from the upholstery 4, which openings 28 can be sealed in this case by means of a zipper 29.

Further, a flap 30 is preferably also provided to the upholstery 4 by means of stitching, sewing or the like, which flap 30 is made of a supple material and is provided with a handle 31 and with means 32 which make it possible to fix this flap 30, in a closed position of the cot 1, at least partially around the cot 1.

In this case, the flap 30 is provided at the standing wall 8 of the first shell part 2 and it is provided with a hook and loop fastener which makes it possible to fix the free far end of the flap 30 to at least a part of the upholstery 4 on the second shell part 3 of the cot 1.

The use of a cot according to the invention is simple and as follows.

When the cot according to the invention is in use or in an open position, as is represented in FIG. 1, the above-mentioned bottom plates 5 and 6 are situated in line and the free edges 12 and 14 of both bottom plates 5, 6 connect.

The cot 1 can be locked in this open position by turning the turning knob 25 or turning knobs, whereby the threaded part 26 of the hinge pin 18 or hinge pins is screwed in the threaded hole 27 of the second shell part 2, such that the gearings 20 and 21 of both shell parts 2, 3 are drawn towards each other and mesh in one another, thus preventing the mutual rotation of the shell parts 2 and 3 around the hinge pins 18.

In this locked open position of the cot 1, the cot can be easily moved while a baby is lying in it, without needing to disturb or to wake the baby.

In order to put away the cot 1 after use, the turning knob 25 or turning knobs are loosened again, as a result of which the gearings 20, 21, thanks to the elasticity of the shell parts 2, 3, move away from each other and thus unlock the shell parts 1, 3 in relation to each other.

Once both gearings 20, 21 are placed at a distance from each other, both shell parts 2 and 3 can be freely rotated in relation to each other into a closed position, as is represented in FIG. 3.

In such a closed position, the shell parts 2 and 3 are folded up, and the standing wall 9 of the second shell part 3 is situated entirely within the first shell part 2, such that a compact shape is obtained.

In the closed position (FIG. 3), the free edges 12 and 14 of both bottom plates 5 and 6 are situated parallel to each other in one and the same plane and hereby form a support for the cot according to the invention.

In order to be able to lock the cot 1 in its closed position, if necessary, in the same manner as described is above, the shell parts 2 and 3 can be locked in this position and/or the above-mentioned flap 30 can be stretched over the back of the bottom plate 6 of the second shell part 3 and it can be fixed to the upholstery 4 of the cot 1 with its hook and loop fastener 32.

It should be noted that the cot 1 according to the invention has an additional advantage in relation to the known cots in that it cannot only be placed in an open or closed position, but also in a large number of intermediate positions, whereby the locking of the cot in such a position can be done in a fast and simple manner by turning the turning knob 25 in an appropriate direction.

It is clear that each of the shell parts 2 and 3 of the cot 1 can each be provided with a separate upholstery 4, which makes replacing the upholstery considerably easier, whereby the upholstery 4 of both shell parts 2, 3 can be fixed in a detachable manner, if necessary, by means of a hook and loop fastener or the like.

It is also clear that the above-mentioned clamping means 19 can be made in many different ways, without thereby hampering the working of the cot 1.

Finally, it should be noted that also the means 32 for fixing the flap 30 can be realized in different ways, for example by providing a button on the upholstery of the second shell part 3 and by providing a buttonhole on the free end of the flap 30.

Moreover, in an open position of the cot 1, the flap 30 can also be applied as an aid to prevent any unwanted shifting of the cot 1, to which end this flap 30 can be put under an edge of, for example a mattress on which the cot 1 is placed.

The present invention is by no means limited to the embodiment described above and represented in the figures; on the contrary, such a cot according to the invention can be made in different shapes and dimensions and according to different variants while still remaining within the scope of the invention.

The invention claimed is:

1. A portable cot comprising first and second shell parts having an upholstery on both shell parts, each shell part being made of a hard material, and including a bottom plate having a free edge and a standing side wall connected to the bottom plate along three sides of a perimeter of the bottom plate and terminating at opposed free standing far ends, said far ends of the standing side wall of the first shell part overlapping the free far ends of the standing side wall of the second shell part;

said shell parts being pivotally connected to each other by coaxial threaded hinge pins threadedly connected to the free ends of the second shell part enabling folding together and securing of the shell parts together against separation, with the free ends of the first shell part pivotally mounted on the hinge pins so that both shell parts are mutually hinged at their respective free standing far ends for movement between an open position, in which both shell parts including their respective bottom plates are in line, and a closed position, in which both shell parts are folded together with their bottom plates parallel to each other, said shell parts and side walls configured so that upon folding into the closed position the standing wall of the second part is substantially entirely disposed within the standing wall of the first shell part, wherein the free ends of the second shell part extend on their far ends beyond an adjacent free edge portion of the bottom plate of the second shell part; and clamping means associated with the hinge pins enabling locking of both shell parts relative to each other in a number of intermediate positions;

wherein the upholstery includes a supple flap having a handle and apertures adjacent said hinge pins, said clamping means extending through said apertures.

2. The cot according to claim 1, said clamping means comprising two ring-shaped gearings with radially directed teeth which are provided opposite and facing each other on both shell parts, located around at least one of the coaxial hinge pins, and means for releasably engaging the gearing to lock the shell parts in relation to each other.

3. The cot according to claim 1, wherein the shell parts are elastic.

4. The cot according to claim 1, wherein the upholstery is provided with means which enable fixing the flap when the cot is in a closed position, at least partially around the cot.

5. The cot according to claim 4, wherein the flap, when the cot is in an open position, is configured to fit under an edge of a mattress on which the cot rests.

6. The cot according to claim 5, wherein both shell parts are provided with a separate upholstery.

7. The cot according to claim 4, wherein the said means enabling fixing of the flap comprises a hook and loop fastener.

8. The cot according to claim 1, wherein the upholstery includes at least one opening through which the shell parts can be removed from the upholstery.

9. The cot according to claim 1, wherein the free edge of the bottom plate of the first shell part includes a recess extending along a central portion thereof, and the free edge of the bottom plate of the second shell part includes a complementary protrusion extending along a central portion thereof mating with said recess when the cot is in the open unfolded position with the bottom plates of the shell parts aligned with each other.

* * * * *